United States Patent [19]

Moudgil

[11] 4,207,175

[45] Jun. 10, 1980

[54] SEPARATION OF MAGNESITE FROM ORES WHICH ALSO CONTAIN CALCITE OR DOLOMITE

[75] Inventor: Brij M. Moudgil, Ontario, Calif.

[73] Assignee: Occidental Research Corporation, La Verne, Calif.

[21] Appl. No.: 897,780

[22] Filed: Apr. 19, 1978

[51] Int. Cl.[2] ..... B07C 5/02; B07C 5/34

[52] U.S. Cl. ..... 209/3.3; 209/576

[58] Field of Search ..... 209/3.1, 3.2, 3.3, 1, 209/3, 4, 9, 578, 576, 577, 580–582

[56] References Cited

U.S. PATENT DOCUMENTS

| | | | |
|---|---|---|---|
| 1,678,884 | 7/1928 | Sweet | 209/3.1 |
| 2,967,614 | 1/1961 | Nury et al. | 209/3.1 |
| 3,346,111 | 10/1967 | Thompson et al. | 209/9 |
| 3,356,211 | 12/1967 | Mathews | 209/3.1 |
| 3,472,375 | 10/1969 | Mathews | 209/3.1 |
| 3,795,310 | 3/1974 | Buchot | 209/3.3 |
| 3,901,793 | 8/1975 | Buchot | 209/1 |
| 3,936,188 | 2/1974 | Sawyer | 209/3.1 |
| 3,992,287 | 11/1976 | Rhys | 209/2 |

*Primary Examiner*—Allen N. Knowles
*Attorney, Agent, or Firm*—Barry A. Bisson

[57] ABSTRACT

A method for the separation of magnesite from a particulate ore containing particles relatively rich in magnesite and particles relatively rich in dolomite and/or calcite, which comprises conditioning the ore with at least one coupling agent selected from saturated and unsaturated carboxylic acids containing from about 4 to about 22 carbon atoms, to selectively coat the calcite and/or dolomite in the ore to the substantial exclusion of the magnesite, in combination with providing at least one fluorescent dye to said coupling agent; radiating the conditioned ore to excite and induce fluorescence of the fluorescent dye to a degree sufficient to distinguish the coated particles from the non-coated particles and separating the fluorescing, coated particles from the non-fluorescing, non-coated particles.

10 Claims, No Drawings

SEPARATION OF MAGNESITE FROM ORES WHICH ALSO CONTAIN CALCITE OR DOLOMITE

BACKGROUND OF THE INVENTION

The present invention relates to a method for the separation of magnesite from ores which also contain calcite and/or dolomite. This invention is especially useful in separating magnesite from calcite and magnesite from dolomite at relatively coarse particle sizes, thereby realizing significant savings in crushing and grinding costs of magnesite containing ores. Magnesite is valuable as a precursor to pure magnesium oxide, the primary use being in refractories.

SUMMARY OF THE INVENTION

This invention makes use of the differences in surface chemical properties of calcite, dolomite and magnesite to separate magnesite from calcite and/or dolomite. In one embodiment of the invention, calcite and dolomite particles are colored or made fluorescent selectively, whereas magnesite particles are not. Separation of calcite and magnesite and dolomite and magnesite can then be achieved by viewing them in ultraviolet light.

In another case magnesite is given a selective coating of the dye and calcite and dolomite particles are left uncoated. Again separation of magnesite from calcite and dolomite is achieved based on the difference in their fluorescence if a fluorescent dye or pigment is used and based on differences in color if a coloring dye or pigment is used.

In accordance with this invention there is disclosed a method for the separation of magnesite from dolomite and/or calcite present in particulate ore which comprises conditioning the particulate ore with at least one coupling agent selected from saturated and unsaturated carboxylic acids containing from about 4 to about 22 carbon atoms, said coupling agent selectively coating dolomite and/or calcite in the particles to the substantial exclusion of coating magnesite in combination with providing at least one fluorescent dye to said coupling agent; radiating the conditioned particulate ore to excite and induce fluorescence of the fluorescent dye to a degree sufficient to distinguish the coated dolomite and/or calcite in the particles from the substantially non-coated magnesite in the particles and separating the fluorescing coated dolomite and/or calcite containing particles from the lesser coated lower-grade magnesite particles and substantially non-coated non-fluorescing higher-grade magnesite particles.

Further, the present invention can be practiced in combination with a method for the separation of higher-grade limestond (and/or dolomite) from lower-grade limestone (and/or dolomite) and/or the silicate-containing gangue present in particulate limestone (and/or dolomite) ore comprising conditioning the particulate limestone (and/or dolomite) ore with at least one coupling agent selected from the group consisting of aliphatic amines containing from about 8 to about 22 carbon atoms and beta amines containing from about 7 to about 21 carbon atoms, said coupling agent selectively coating the silicates in the gangue particles to the substantial exclusion of coating the calcium carbonate (and/or dolomite) in the particles, in combination with providing at least one fluorescent dye to said coupling agent; radiating the conditioned particulate limestone ore to excite and induce fluorescence of the fluorescent dye to a degree sufficient to distinguish the coated gangue particles and partially coated lower-grade limestone (and/or dolomite) from the lesser coated higher-grade limestone (and/or dolomite) particles and separating the fluorescing, coated gangue and lower-grade particles from the higher-grade particles. This invention is further described in application Ser. No. 897,740 filed on the same day as the present application, by Brij Moudgil, titled "Separation of Limestone from Limestone Ore", the entire disclosure of which is hereby incorporated herein.

To provide the dye to the coupling agent coated particles to the substantial exclusion of the non-coated particles, the coupling agent is water insoluble when the fluorescent dye is water insoluble. However, a water soluble coupling agent and a water insoluble dye can be used to provide a dye-coupled to the coating on a selected particle. For example, a water soluble amine coupling agent can be coated on one substance (e.g., the silicates) in a mixture of particles then applying an oil soluble dye such as fluoranthene in a nonreactive oil such as a paraffinic oil (e.g., S.A.E. 20 base lubricating oil without additives). The silicate particles are rendered hydrophobic or oleophilic by the amine coating, which attracts the water insoluble dye in the oil thereby coupling the dye to the coated particles.

Water soluble coupling agents and water soluble dyes can be used if a chemical bond is formed during conditioning having sufficient strength to avoid removal during the subsequent stages of the method such as a subsequent rinsing step. Also, nonreactive water soluble dyes and water soluble coupling agents can be used if not removed in the subsequent steps of the method. For example, a water soluble dye can be applied at a temperature which is higher than the temperature of the subsequent steps (e.g., a hot dye application and a cold rinse). Also exemplary, a water soluble amine can be used as a coupling agent, whereupon following conditioning of the particles with the amine a prepolymer forming agent, such as formaldehyde, is added forming a prepolymer with the amine which upon subsequent contact with acid and/or heat polymerizes forming a water insoluble coating.

To provide the dye to the particles which are selectively non-coated with the coupling agent to the substantial exclusion of the coated particles, a water insoluble coupling agent and a water soluble dye, or a water soluble agent and a water insoluble dye can be used. For example, a water insoluble coupling agent such as oleic acid can be caused to adhere to one substance within a mixture of particles (e.g., the calcite), then the entire mixture can be exposed to an aqueous water soluble dye, such as rhodamine B, flavine FF, or uranine, whereby the water insoluble agent renders the calcite particle hydrophobic wherein the dye does not adhere but wherein the dye does adhere to the hydrophilic non-coated particles. In such an application of the method of this invention, a relatively gentle stream of air can be used to remove small droplets of the water soluble dye from the hydrophobic particles, thus eliminating the need for a subsequent rinse step in the method. Such a stream of air can be applied by means of the apparatus in application Ser. No. 897,946 filed on the same day as the present application by Brij Mohan Moudgil and John G. Roeschlaub titled "Method and Apparatus for Selective Wetting of Particles" (the entire disclosure of which is hereby incorporated herein), by passing ore through a plurality of nozzle arrangements which are substantially perpendicular to a free-falling stream of the ore particles. The rinse step can also be eliminated in the practice of the method of this invention, if the concentration of the coupling agent and the concentration of the dye is sufficiently low.

It is understood, of course, that the principles described herein can be used to separate a higher-grade magnesite from a lower-grade magnesite and calcite and/or dolomite as the coated higher-grade magnesite particles can have a lesser intensity of fluorescence than the lower-grade magnesite particles (containing dolomite and/or calcite). The higher-grade and lower-grade magnesite particles can thereby be separated by adjusting the sorting apparatus to accept those particles exhibiting fluorescence above a certain minimum intensity level and rejecting those particles (e.g., the higher-grade magnesite) exhibiting no fluorescence and/or fluorescence below such minimum intensity level.

Detailed Description of the Invention

According to the present invention, there is provided a method for the separation of magnesite from calcium and/or calcium-magnesium compounds present in magnesite ore to recover magnesite values therefrom. As used herein the phrase "separation of magnesite from calcite and/or dolomite" includes the separation of higher-grade magnesite from lower-grade magnesite as well as separation of magnesite and/or calcite and/or dolomite from gangue. By the terms "higher-grade magnesite" and "lower-grade magnesite" is meant a relative distinction in magnesium carbonate content between two grades of limestone. Such a relative distinction can be variable depending upon the reason for distinguishing between magnesite grades such as grading the magnesite in consonance with the numerous end uses of the magnesite.

Selective coating of a color or fluorescent dye on calcite, dolomite or magnesite can be obtained by treating the material with an aqueous dispersion of a surface active agent and dye combination. The dye could also be dissolved in a non-reactive organic which is compatable with the surface active agent. In the second case the material is first treated with a dispersion of surface active agent and then with a dispersion of the dye dissolved in the non-reactive organic. A rinse step can follow the conditioning step to remove any mechanically adhered dye. Separation of the coated and non-coated material can be achieved with a machine such as developed by Ted Mathews or by hand sorting.

The method of the present invention is based upon the differences in surface properties of the various material present in magnesite ores to accept coupling agents and dyes attracted thereto or repulses thereby. Due to these differences, there can be chosen a coupling agent or mixture of coupling agents that will effectively selectively coat only the magnesite or the calcite and/or dolomite. Surface properties are relatively more consistent that other properties such as color, reflectance, or conductivity. These other properties generally tend to be similar such that a fine degree of resolution is required to distinguish between the materials. Such a degree of resolution is difficult to obtain and the efficiency of separation based upon these properties, therefore, suffers. Separation of material based upon the surface properties is, therefore, more consistent than techniques based upon the above other properties.

To distinguish between the coupling agent coated material and the non-coated material, there is incorporated with the coupling agent a tagging agent such as a coloring agent or fluorescent dye or there is added a tagging agent, such as a coloring agent or a fluorescent dye, that is repulsed by the coupling agent. The ore can then be sorted by visible optical means or radiated with electromagnetic radiation to induce the dye to fluoresce. In the latter case, the dye combined with the coupling agent coating of some of the material fluoresces and the substantially non-coated material does not fluoresce to any substantial degree, or if the dye is repulsed by the coupling agent, the non-coupling-agent-coated particles exhibit fluorescence while the coupling agent coated particles do not fluoresce to any substantial degree. Thereby, the different materials can be separated.

Generally, fluorescene refers to the property of absorbing radiation at one particular wavelength and simultaneously re-emitting light of a different wavelength so long as the stimulus is active. It is intended in the present method to use the term "fluorescence" to indicate that property of absorbing radiation at one particular wavelength and re-emitting it at a different wavelength, whether or not visible, during exposure to an active stimulus or after exposure or during both these time periods. Thus, fluorescence is used generically herein to include fluorescence, phosphorescence, and envisions the emission of electromagnetic waves whether or not within the visible spectrum.

Electromagnetic radiation generally refers to the emission of energy waves of all the various wavelengths encompassed by the entire electromagnetic spectrum. It is intended in the present method to use the term electromagnetic radiation to indicate any and all stimuli that will excite and induce fluorescence of the fluorescent dye. Thus, electromagnetic radiation is used generically herein to include electromagnetic radiation and envisions other stimuli that will excite and induce fluorescence of the fluorescent dye.

In practicing the present method in regard to an ore which contains magnesite and calcite and/or dolomite, the ore is first subjected to a crushing step. In this crushing step, the ore is crushed to physically separate the magnesite from the other material present. Crushing increases the surface area of the particles and further provides a greater surface and reactive site for the coating of the particles by the coupling agent. The ore is preferably crushed to a particle size of from about ¼ inch to about 8 inches. Particle sizes of less than ¼ inch can be used in the practice of this invention; however, such sizes require greater amounts of coupling agent and are more difficult to separate. Particle sizes of greater than 8 inches can be used in the practice of this invention, but generally entrain impurities such that separation efficiency decreases. It is preferred to use ore particles of from about ½ inch to about 3 inches. Following the crushing and sizing steps the ore particles can be deslimed to remove soluble impurities and surface fines on the particles.

The method of this invention is practiced in regard to magnesite ore by conditioning the ore following sizing with a coupling agent or mixture of coupling agents that selectively adheres to the magnesite or the dolomite and/or calcite present in the ore. It is preferred to condition the ore with a coupling agent or mixture of coupling agents that selectively coats the calcite and/or dolomite in the ore.

Coupling agents that are useful in the practice of this method to coat the calcite and/or dolomite present in the ore particles can be selected from saturated and unsaturated carboxylic acids including fatty acids which contain from about 5 to about 22 carbon atoms, or a mixture thereof. Carboxylic acids that can be used include palmitoleic acid, oleic acid, linoleic acid, caproic acid, caprylic acid, capric acid, lauric acid, myristic acid, palmitic acid, stearic acid, arachidic acid, behenic acid, tall oil fatty acids and the like. It is preferred to use at least one carboxylic acid containing from about 8 to about 18 carbon atoms. Carboxylic acids containing more than about 22 carbon atoms can be used, but generally tend to be less selective and thereby coat calcite and/or dolomite and magnesite particles. Carboxylic acids of less than 5 carbon atoms generally do not possess the ability to coat any of the particles. In general, the preferred carboxylic acid enters a chemical reaction with the calcium carbonate or calcium-magnesium carbonate; for example, oleic acid reacts to form calcium oleate.

To coat the silicate-containing gangue, if present in the ore, a coupling agent can be selected from aliphatic amines, or a mixture thereof, containing from about 8 to about 22 carbon atoms and beta amines or mixture thereof containing from about 7 to about 21 carbon atoms. Aliphatic amines useful in this method include octyl amine, decyl amine, dodecyl amine, tetradecyl amine, hexadecyl amine, octadecyl amine, eicosanyl amine, docosanyl amine and the like. Beta amines can include commercially available beta amines such as ARMEEN L-7 through L-15 series, which are registered trademarked products of Armak Chemicals and are known to those skilled in the art. Generally, the amines containing more than about 22 carbon atoms are not as selective as the amines containing less than about 22 carbon atoms. Aliphatic amines of less than about 8 carbon atoms and beta amines of less than about 7 carbon atoms generally to not have the desired coating properties. It is preferred to use an aliphatic amine containing from about 10 to about 18 carbon atoms and a beta amine containing from about 7 to about 15 carbon atoms. Of the amines the beta amines are more selective for silicates rather than carbonates and therefore are preferred. A water soluble amine coupling agent selected from the water soluble salts of the above identified aliphatic and beta amines can also be used.

A fluorescent dye is combined with the coupling agents used to condition the ore. The fluorescent dye can be combined with the coupling agent either before or after the ore is conditioned. Fluorescent dyes known to those skilled in the art, and which are compatible with the coupling agents, can be used in the practice of the method of this invention. It is preferred to use a water soluble fluorescent dye when a water insoluble coupling agent is used. Water soluble fluorescent dyes can dissolve into the water dispersant during the conditioning step and can thereby impart a fluorescing property to substantially all the particles if an aqueous layer coats their surface. Fluorescent dyes that can be used include fluoranthene, Fluorescent Yellow G (a product of Morton Norwich Chemical Co.), rhodamine B, flavine FF, uranine and the like. The fluorescent dye can be used in any form such as a solution, suspension, emulsion, dispersion, or alone. The fluorescent dye can be combined with the coupling agent prior to conditioning the ore by either mixing the fluorescent dye directly with the coupling agent or by mixing the fluorescent dye with a suitable diluent or solvent, such as an oil, then mixing with the coupling agent. If the fluorescent dye is combined with the coupling agent following the conditioning, it can be applied directly to the conditioned ore or it can be used in any of the above-mentioned convenient forms. The fluorescent dye has an affinity toward the coupling agent coating and will, therefore, be preferentially entrained in only the coated ore particles. Any dye that adheres to the non-coated particles, generally, is removed by an aqueous wash of the ore. It is preferred to combine the coupling agent and fluorescent dye prior to conditioning the ore. Such prior treatment uses less fluorescent dye, requires fewer steps, and is generally more efficient both economically and in separation results.

Following the crushing and sizing of the ore, the ore is conditioned with the coupling agent. Conditioning of the ore with the coupling agent is accomplished by contacting the sized ore with the coupling agent. The coupling agent can be used in any suitable manner such as in solution, dispersion, or by itself. It is preferred to form a dispersion of the coupling agent in water. Many methods of contacting the ore with the aqueous dispersion are available and known to those skilled in the art. Such methods include the spraying of the aqueous dispersion onto the sized ore, the passing of the ore through a dispersion bath, and the like. It is preferred to spray the sized ore with the aqueous dispersion. Spraying techniques include, but are not limited to, spraying the dispersion onto the ore as the ore passes the spraying nozzle on a vibrating screen or belt, or spraying the ore as it passes through a ring or series of ring sprayers, such as is shown in United States Application Ser. No. 897,946 filed on the same day as the present application by Moudgil and Roeschlaub, entitled METHOD AND APPARATUS FOR SELECTIVE WETTING OF PARTICLES, the entire disclosure of which is incorporated herein by this reference.

Following the spraying of the ore with the aqueous dispersion, the ore is rinsed with a suitable washing agent, such as water, to remove excess dispersion from the ore and any dispersion physically entrained in the ore. The coupling agent, combined with the fluorescent dye, will selectively remain coated on the particles for which it has a preference due to the surface properties of the particles. The coated particles are capable of fluorescence when radiated with electromagnetic radiation.

Following the conditioning of the ore, if the adherent dye or pigment is fluorescent, the ore is exposed to electromagnetic radiation to induce the coating on the particles to fluoresce. The coated, fluorescing paticles can be separated by any convenient means such as by hand, by optical sorting device, and by apparatus as taught by Matthew's U.S. Pat. No. 3,472,375, which is incorporated herein by reference. In such apparatus a free falling mixture of ore passes in front of a row of detectors. Each detector by proper attenuation is capable of distinguishing between non-fluorescence and fluorescence or in intensity of fluorescence. Each detector in turn controls one flowing fluid stream selectively directed transverse to the path of the falling particle, the fluid stream being permitted to impinge only on the properly emitting ore particles. The directed fluid stream deflects the ore particles into a divergent path by which they are separated from the undesired ore particles. Such an apparatus is capable of detecting and separating the coupling agent and dye-coated particles from the non-coated particles.

The invention is further illustrated by the following examples, which are not intended to be limiting.

EXAMPLE 1

A synthetic sample of calcite and magnesite particles of about ½ inch size was washed to remove surface fines. Amount of calcite and magnesite in the sample was in the ratio 1:1. The sample after desliming was conditioned with an aqueous suspension of about 2 percent oleic acid in which about two percent fluorescent dye, fluoranthene, was dissolved. Good fluorescent coating on calcite particles and poor coating on magnesite was obtained. Based on the difference in fluorescence under ultraviolet light, magnesite particles (less fluoresent and non-fluorescent) were separated from calcite particles (more fluorescent).

EXAMPLE 2

A synthetic sample of dolomite and magnesite in the ratio 1:1 was deslimed. Particle size of dolomite and magnesite was about ½ inch. After desliming, the material was conditioned with an aqueous suspension of about 2 percent oleic acid in which about two percent fluoranthene was dissolved. Good fluorescent coating was obtained on dolomite particles. Poor coating was obtained on magnesite particles. The difference in intensity of fluorescence was improved upon rinsing the material with water. Separation of dolomite particles (fluorescent) was achieved from magnesite (less fluorescent and non-fluorescent) under ultraviolet light.

The method of the present invention can also be used in optical, non-fluorescent separation systems by substituting for the fluorescent dye described herein, a dye that provides a distinct color within the visible spectrum.

The present invention can also be used to separate iron-containing ores, (e.g., "banded" iron ores) such as magnatite from calcite and/or dolomite, since the magnatite is substantially non-coated by the carboxylic acid.

What is claimed:

1. A process for the separation of higher-grade magnesite from lower-grade magnesite and at least one mineral selected from dolomite and calcite present in particulate ore which comprises:

(a) conditioning the particulate ore by contacting it with at least one coupling agent selected from saturated and unsaturated carboxylic acids containing from about 4 to about 22 carbon atoms, combining with said coupling agent at least one fluorescent dye before or after conditioning the particulate ore with the coupling agent, said coupling agent selectively coating at least one mineral selected from calcite and dolomite in the ore and in a relative lesser amount coating lower-grade magnesite to the substantial exclusion of coating higher-grade magnesite; and (b) exposing the conditioned particulate ore to electromagnetic radiation to excite and induce fluorescence of the fluorescent dye to a degree sufficient to distinguish higher-grade magnesite particles from lower-grade magnesite particles and mineral particles selected from at least dolomite and calcite particles and separating the higher-grade magnesite particles from said lower-grade magnesite and said mineral particles.

2. The process of claim 1 wherein the particulate ore is of a particle size of from about ¼ inch to about 8 inches.

3. The process of claim 2 wherein the particulate ore is of a particle size of from about ½ inch to about 3 inches.

4. The process of claim 1 wherein said coupling agent is at least one carboxylic acid containing from about 8 to about 18 carbon atoms.

5. The process of claim 1 wherein said coupling agent is oleic acid.

6. The method of claim 1 wherein said fluorescent dye is combined with the coupling agent prior to the conditioning of the ore.

7. The method of claim 1 wherein said fluorescent dye is combined with the coupling agent after the conditioning of the ore.

8. The method of claim 1 wherein said fluorescent dye is oil soluble.

9. The method of claim 8 wherein said fluorescent dye is selected from the group consisting of fluoranthene, fluorescent yellow G and mixtures thereof.

10. A process for the separation of magnesite from at least one mineral selected from calcite and dolomite in particulate ore, comprising:

(a) conditioning the particulate ore by contacting it with at least one coupling agent selected from the group consisting of carboxylic acid containing from about 4 to about 22 carbon atoms and combining with said coupling agent at least one fluorescent dye before or after conditioning the particulate ore with the coupling agent, said coupling agent selectively coating at least one mineral selected from calcite and dolomite in the ore particles to the substantial exclusion of coating magnesite in the particles;

(b) exposing the conditioned particulate ore to electromagnetic radiation to excite and induce fluorescene of the fluorescent dye to a degree sufficient to distinguish the coated mineral particles containing at least one mineral selected from calcite and dolomite from the non-coated and lesser coated magnesite containing particles; and (c) separating the fluorescing particles containing at least one mineral selected from calcite and dolomite from the magnesite containing particles.

* * * * *

UNITED STATES PATENT AND TRADEMARK OFFICE

CERTIFICATE OF CORRECTION

PATENT NO. : 4,207,175

DATED : June 10, 1980

INVENTOR(S) : Brij M. Moudgil

It is certified that error appears in the above—identified patent and that said Letters Patent is hereby corrected as shown below:

Column 1, line 54, change "limestond" to -- limestone --.
Column 2, line 49, after "soluble" add -- coupling --.
Column 2, line 55, after "insoluble" add -- coupling --.
Column 3, line 55, change "repulses" to -- repulsed --.
Column 3, line 60, change "that" to -- than --.
Column 4, line 18, change "fluorescene" to -- fluorescence --.
Column 5, line 39, change "to" to -- do --.
Column 5, line 55, change "soluble" to -- insoluble --.
Column 6, line 53, change "paticles" to -- particles --.
Column 6, line 56, change "Matthew's" to -- Mathews' --.
Column 7, line 14, after "magnesite" add -- particles --.
Column 7, line 32, after "magnesite" add -- particles --.
Column 7, line 42, change "magnatite" to -- magnetite --.
Column 7, lines 42-43, change "magnatite" to -- magnetite --.

Signed and Sealed this

*Seventh* Day of *October 1980*

[SEAL]

*Attest:*

SIDNEY A. DIAMOND

*Attesting Officer*

*Commissioner of Patents and Trademarks*